US006965505B1

(12) United States Patent
Mack et al.

(10) Patent No.: US 6,965,505 B1
(45) Date of Patent: Nov. 15, 2005

(54) SHIP DEGAUSSING SYSTEM AND ALGORITHM

(75) Inventors: Richard M. Mack, Gaithersburg, MD (US); Robert A. Wingo, Manassas, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 330 days.

(21) Appl. No.: 10/447,950

(22) Filed: May 30, 2003

(51) Int. Cl.[7] ..... H01F 13/00
(52) U.S. Cl. ..... 361/149
(58) Field of Search ..... 361/149

(56) References Cited

U.S. PATENT DOCUMENTS 4,734,816 A * 3/1988 Guillemin et al. ..... 361/149
4,993,345 A * 2/1991 Feldman ..... 114/240 R
5,189,590 A 2/1993 Schneider
5,463,523 A 10/1995 Holmes et al.
5,483,410 A 1/1996 Holmes et al.
5,952,734 A * 9/1999 Gelbien ..... 307/91
6,273,272 B1 8/2001 Scarzello
6,344,743 B1 2/2002 Holmes et al.
6,417,665 B1 7/2002 Scarzello et al.
6,456,069 B1 9/2002 Scarzello et al.
6,714,008 B1 * 3/2004 Holmes et al. ..... 324/261
6,760,210 B1 * 7/2004 Abramov et al. ..... 361/149
6,798,632 B1 * 9/2004 Holmes et al. ..... 361/143

* cited by examiner

*Primary Examiner*—Brian Sircus
*Assistant Examiner*—James Demakis
(74) *Attorney, Agent, or Firm*—Howard Kaiser

(57) ABSTRACT

At a ship's magnetic silencing facility, calibration measurements are taken of onboard magnetic fields, and the offboard magnetic signature is minimized through an iterative degaussing process. Current data associated with the signature minimization is retained by a processor-controller implemented, along with degaussing coils and other apparatus, in a CLDG system effectuated onboard in a manner continually adaptive to changing conditions while voyaging. According to the CLDG methodology: Real time measurements are taken of the onboard magnetic fields, and are modified to account for the degaussing coils' magnetic effects. Via least squares fit mathematics, scale factors are calculated based on the relationship between (i) the real time measurements (as modified) of the onboard magnetic fields and (ii) the calibration measurements of the onboard magnetic fields. The scale factors and the current data are multiplied, the resultant products are summarized, and the ship's degaussing is caused to occur correspondingly with the summarization.

15 Claims, 7 Drawing Sheets

SHIP DEGAUSSING SYSTEM AND ALGORITHM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to degaussing, more particularly to closed loop degaussing (CLDG) of naval vessels.

The objective of a ship degaussing system is to maintain minimal magnetic signatures of a ship in order to maintain minimal susceptibility of the ship to magnetic mines. To this end, a ship degaussing system will seek to compensate for the ship's own magnetic signature as well as for the induced magnetism associated with the ship's navigation through the earth's magnetic field. Typically, the conventional (non-CLDG) system includes compensation coils, a single total-field magnetometer mounted on the mast, an automatic controller, power amplifier units and power supply units that control DC currents in the compensation coils.

The U.S. Navy has developed a closed loop degaussing (abbreviated "CLDG" for "Closed Loop De-Gaussing") system that actively compensates for the induced and permanent magnetic signals of a ship. Essentially, CLDG is an onboard electromechanical system that measures onboard local magnetic fields and, using the onboard measurements, estimates the offboard magnetic fields. CLDG basically involves coil design, modern electronics and computer technology (including algorithmic control). The apparatus needed to perform CLDG includes onboard magnetometers, degaussing coils, analog-to-digital conversion/control equipment and a processing computer to execute the CLDG algorithm. Degaussing coils are already installed as standard items aboard many modern U.S. Navy ships.

Not unlike a conventional degaussing (non-CLDG) system, a closed loop degaussing (CLDG) system employs degaussing coils for conducting electrical current. However, in contrast to conventional (non-CLDG) degaussing, closed loop degaussing involves a computerized feedback control system that, in real time on a continual basis, compensates for the changes in the ship's magnetization on the basis of onboard magnetic measurements. CLDG implements an array of magnetic field sensors situated throughout the ship. During navigation, these onboard sensors constantly monitor the magnetic environment of the ship so as to detect variations in the ship's magnetic signature.

In principle, as compared with conventional (non-CLDG) degaussing systems currently installed on many Navy ships, CLDG can afford more accurate control of degaussing currents for purposes of minimizing the ship's magnetic signature, and can permit longer ship deployment periods between calibrations at degaussing facilities such as degaussing ranges. The CLDG algorithm currently installed aboard two U.S. Navy ships has a theoretical inaccuracy of about ten percent. It is desirable to have a CLDG system that affords greater accuracy than does the current CLDG system.

The following United States patents are incorporated herein by reference: Schneider, "Closed-Loop Multi-Sensor Control System and Method," U.S. Pat. No. 5,189,590, issued 23 Feb. 1993; Holmes et al., "Zero Field Degaussing System and Method," U.S. Pat. No. 5,463,523, issued 31 Oct. 1995; Holmes et al., "Advanced Degaussing Coil System," U.S. Pat. No. 5,483,410, issued 9 Jan. 1996; Scarzello et al., "Integrating Fluxgate Magnetometer," U.S. Pat. No. 6,278,272 B1, issued 21 Aug. 2001; Holmes et al., "Standing Wave Magnetometer," U.S. Pat. No. 6,344,743 B1, issued 5 Feb. 2002. Scarzello et al., "Spatially Integrating Fluxgate Magnetometer Having a Flexible Magnetic Core," U.S. Pat. No. 6,416,665 B1, issued 9 Jul. 2002; Scarzello et al., "Fluxgate Magnetic Field Sensor Incorporating Ferromagnetic Test Material into Its Magnetic Circuitry," U.S. Pat. No. 6,456,069 B1, issued 24 Sep. 2002.

SUMMARY OF THE INVENTION

In view of the foregoing, it is an object of the present invention to provide a more accurate algorithm for effecting closed loop degaussing of naval vessels.

The CLDG system in accordance with the present invention requires basically the same hardware as does the current CLDG system. However, based on U.S. Navy investigation, the current CLDG system is characterized by a theoretical inaccuracy of about ten percent in the ultimate degaussing step, whereas the present invention's CLDG system is characterized by a theoretical inaccuracy of about five percent or less in the ultimate degaussing step.

According to frequent inventive practice, the present invention provides a method for effecting degaussing of a marine vessel having degaussing coils associated therewith. The inventive method comprises certain steps performed during non-navigation of the marine vessel, and certain other steps performed during navigation of the marine vessel. The inventive method comprises the following steps to be performed during non-navigation of the marine vessel: obtaining calibration onboard magnetic field measurements relating to the marine vessel; iteratively, at least twice, applying degaussing current to the degaussing coils until reaching a selected reduction of the off-board magnetic signature relating to the marine vessel; and, obtaining current values of the degaussing current which is applied upon reaching the selected reduction of the off-board magnetic signature. The inventive method further comprises the following steps to be performed during navigation of the marine vessel: obtaining real time onboard magnetic field measurements relating to the marine vessel; determining scale factors, wherein the determination of scale factors includes the fitting of the obtained real time onboard magnetic field measurements with respect to the obtained calibration onboard magnetic field measurements; finding products of the determined scale factors and the obtained current values; and, applying degaussing current to the degaussing coils in accordance with the summation of the products. Typically, the steps performed during navigation are performed onboard the marine vessel in the manner of a "closed loop" or "continuous feedback" system.

According to many embodiments of the present invention, a closed loop degaussing system for a ship comprises plural degaussing coils and a machine having a memory. The degaussing coils are installed onboard the ship. The machine is connected to the degaussing coils. The machine contains a data representation pertaining to an amount of current to be applied to the degaussing coils so as to at least substantially minimize, on a continual basis, the off-board magnetic signature associated with the ship. The data representation is generated, for availability for containment by the machine, by the method comprising relating presently obtained real time data to previously obtained calibration data. The calibration data includes plural onboard-signature calibration values and plural current calibration values. The current calibration values are indicative of the amount of current used to at least substantially minimize, on a calibration basis, the off-board magnetic signature associated with the ship. The real time data includes plural onboard signature real time values and real time scale factors. The relating of the real time data to the calibration data includes: calculating real time scale values, wherein the calculating of the real time scale values includes performing a least squares fit of the onboard signature real time values relative to the onboard signature calibration values; multiplying the calculated real time scale values by the current calibration values; summing the products of the multiplying; and causing the application of current to the degaussing coils in an amount indicative of the summed products.

A typical embodiment of a computer program product according to the present invention comprises a computer useable medium having computer program logic recorded thereon for enabling a computer to control the amount of current conducted by degaussing coils which are installed onboard a ship. The computer program logic comprises: means for enabling the computer to input onboard signature calibration values and current calibration values which have previously been obtained at a magnetic calibration facility, the current calibration values being representative of a substantially minimized off-board magnetic signature associated with the ship; means for enabling the computer, in an ongoing manner, to input onboard signature real time values which are presently being obtained onboard the ship; means for enabling the computer, in an ongoing manner, to compensate the input onboard signature real time values for magnetic influence of said degaussing coils; means for enabling the computer, in an ongoing manner, to calculate scale factors based on a least squares fit of the compensated onboard signature real time values and the onboard signature calibration values; means for enabling the computer, in an ongoing manner, to calculate the sum of the products of the calculated scale factors and the current calibration values; and, means for enabling the computer, in an ongoing manner, to cause current to be conducted by the degaussing coils in an amount commensurate with the sum of the products. According to usual inventive practice, the onboard signature calibration values, the current calibration values, the onboard signature real time values and the calculated scale factors are each categorized in terms of induced magnetic signature, permanent magnetic signature and change-in-permanent magnetic signature. Each product is of a calculated scale factor and a current calibration value which are identically categorized.

The present invention's CLDG algorithm represents an improvement over the current CLDG algorithm. The current CLDG algorithm compensates both permanent and induced magnetization changes by measuring the onboard state, fitting the measured onboard state with a set of known states of the ship, predicting the off-board state, and determining the amount of degaussing current needed. The present invention's CLDG algorithm is similar insofar as it uses known states or measured calibration states; however, the present invention's CLDG algorithm degausses these states beforehand, using iteration, to approximately five percent root-mean-square (5% RMS) of each state's initial signal. After the initial least-square (LSQ) fit to the measured onboard values, the off-board signal is degaussed by scaling the degaussing currents associated with each calibration vector. By "pre-degaussing" each calibration vector to approximately 5% RMS, the present invention improves system accuracy by approximately 50% over existing CLDG methods.

As further explained hereinbelow with reference to FIG. 1, a calibration vector (sometimes abbreviated herein "cal vector") is a simultaneous sampling of the onboard and off-board magnetometers, and is usually associated with a unique ship magnetic state.

The present invention thus features the "pre-degaussing" of each of the individual vector states in the calibration database. The present invention's. CLDG system represents an "iterative" CLDG system involving preliminary degaussing of the magnetic states used to characterize the vessel's magnetic signature. It is reasonably expected that the total error will be lower in accordance with the present invention, because each state will have been degaussed individually, instead of lumped together and then degaussed as in the current CLDG algorithm. According to the present invention, each state is degaussed as it is measured, using iteration, so that only 5% RMS of each state's signal remains. The present invention therefore has a theoretical error of about five percent RMS, and thus represents an overall improvement of about fifty percent relative to the current approach to CLDG degaussing, which has a theoretical error of about ten percent RMS.

The present invention also features a final degaussing step comprising an uncomplicated summation of individually scaled currents corresponding to individual vector states. The present invention thus advantageously obviates the need for performing off-board least-square fit calculations in a final degaussing step, as required according to current CLDG degaussing. The present invention hence carries a lower computational burden during operation, as compared with the current CLDG approach. The current CLDG system must perform a final least-square fit of the coil effects to the predicted off-board. This mathematically complex step is unnecessary according to the present invention's algorithm, according to which the coil currents are simply summed up from the scale factors determined previously.

The present invention is further advantageous in terms of time and cost savings. The ships will not need to be calibrated at shore-based facilities as frequently, because the present invention's algorithm will maintain satisfactory signature levels longer than will current methodologies.

Other objects, advantages and features of this invention will become apparent from the following detailed description of the invention when considered in conjunction with the accompanying drawings.

BRIEF DESCRIPTION OF THE DRAWINGS

In order that the present invention may be clearly understood, it will now be described, by way of example, with reference to the accompanying drawings, wherein like numbers indicate the same or similar components, and wherein.

DETAILED DESCRIPTION OF THE INVENTION

Figure 1:
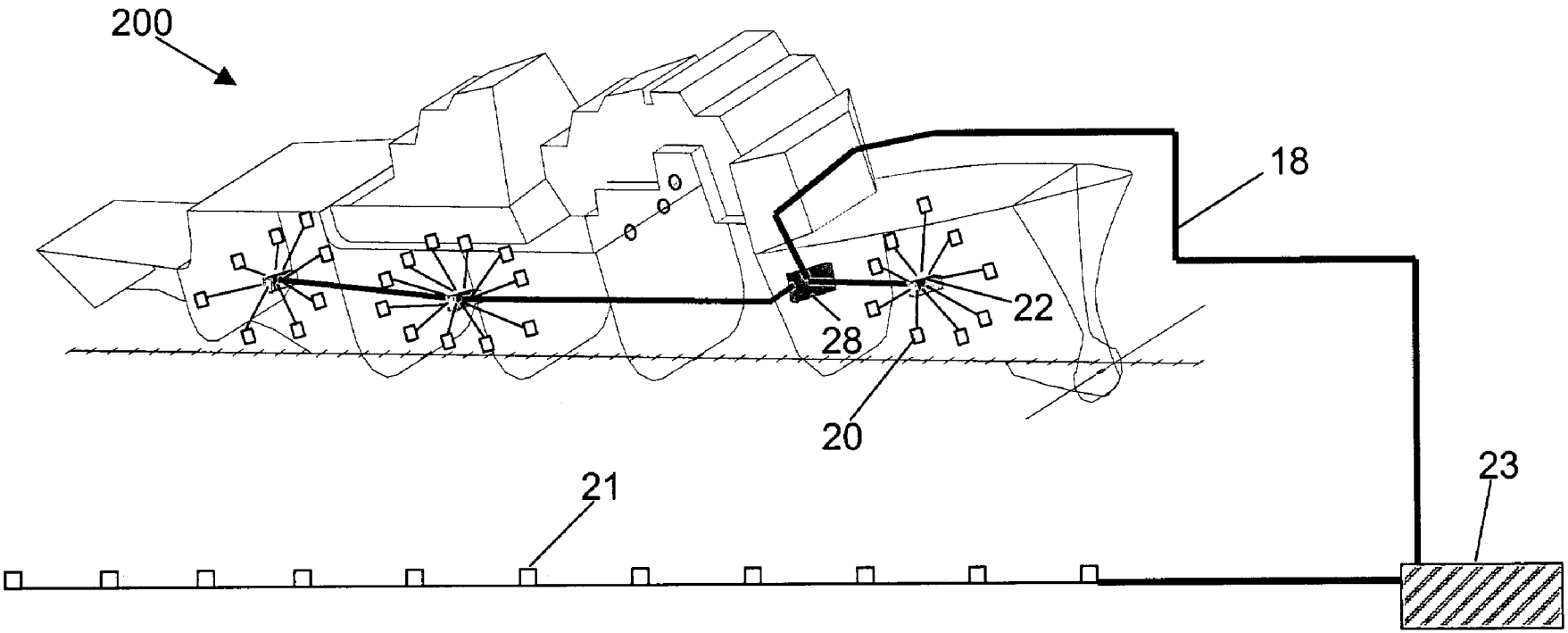
FIG. 1 is a diagrammatic perspective view of a representative vessel having CLDG shipboard equipment installed therein and being ranged at a magnetic silencing facility, particularly illustrating definition and measurement of a calibration vector.
Figure 3:
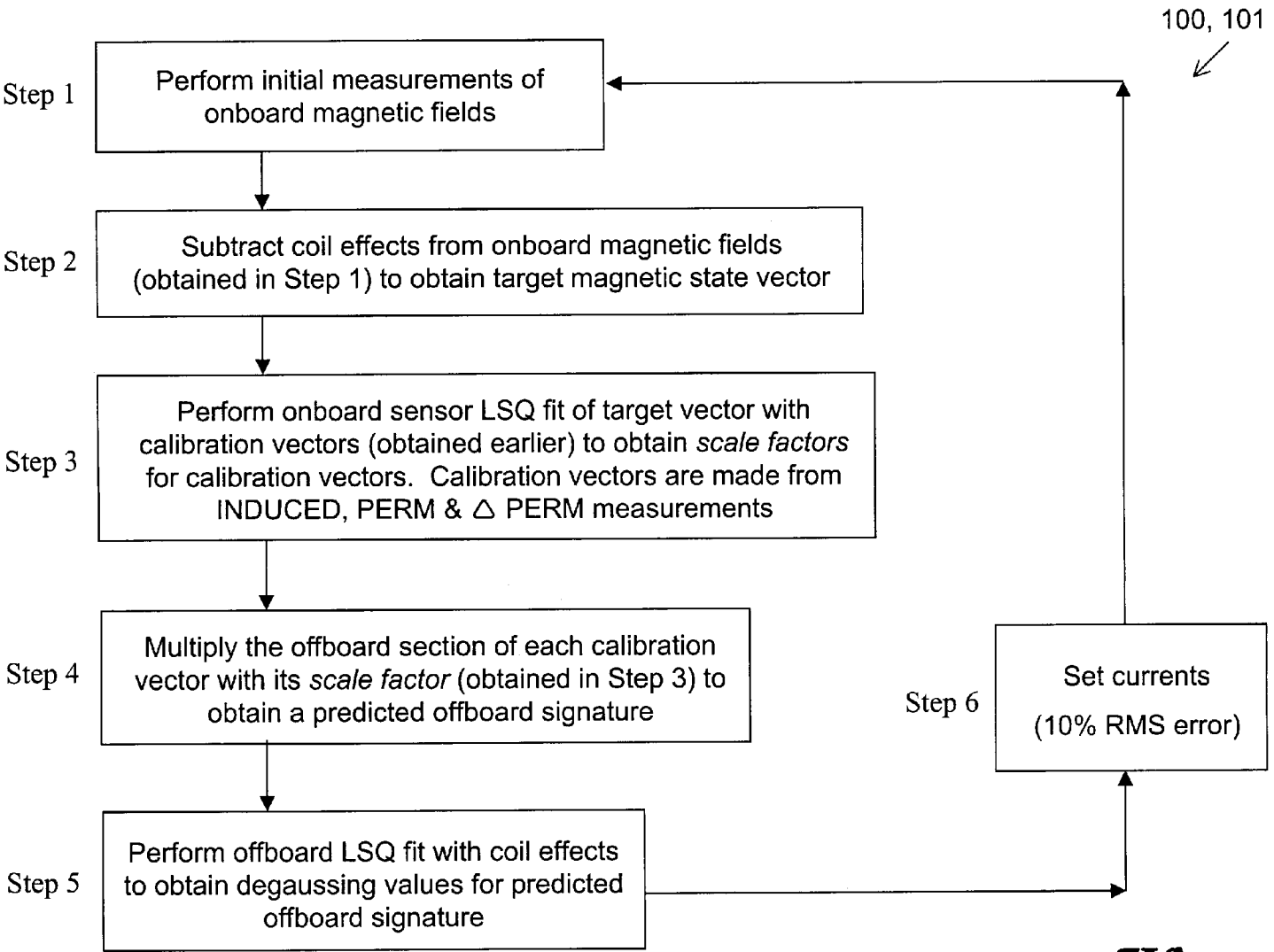
FIG. 3 is a block diagram of the old CLDG system, which is currently used onboard a U.S. Navy ship.

Reference is now made to FIG. 1, which shows how a calibration vector is created and measured. A typical U.S. Navy ship 200 having installed thereon the prevailing CLDG system 100 (such as shown in FIG. 3) is calibrated (e.g., "ranged") at a shore facility (e.g., "magnetic silencing facility") 23. Let us assume that ship 200 is in a "unique" magnetic state. Ship-based magnetic sensors 20 (e.g., magnetometers) are located aboard ship 200. Submerged shore-based magnetic sensors 21 (e.g., magnetometers) are located below ship 200. When ship 200 is in a magnetically unique state, measurements are performed using the onboard magnetic sensors 20 and the off-board magnetic sensors 21. Data is collected at shore facility 23. This pairing of the unique onboard and off-board magnetic states is called a "calibration vector." Like a regular vector having magnitude and direction, this multidimensional vector has magnitude (e.g., the value of each magnetic sensor) and direction (e.g., the physical position of each magnetic sensor).

Figure 2:
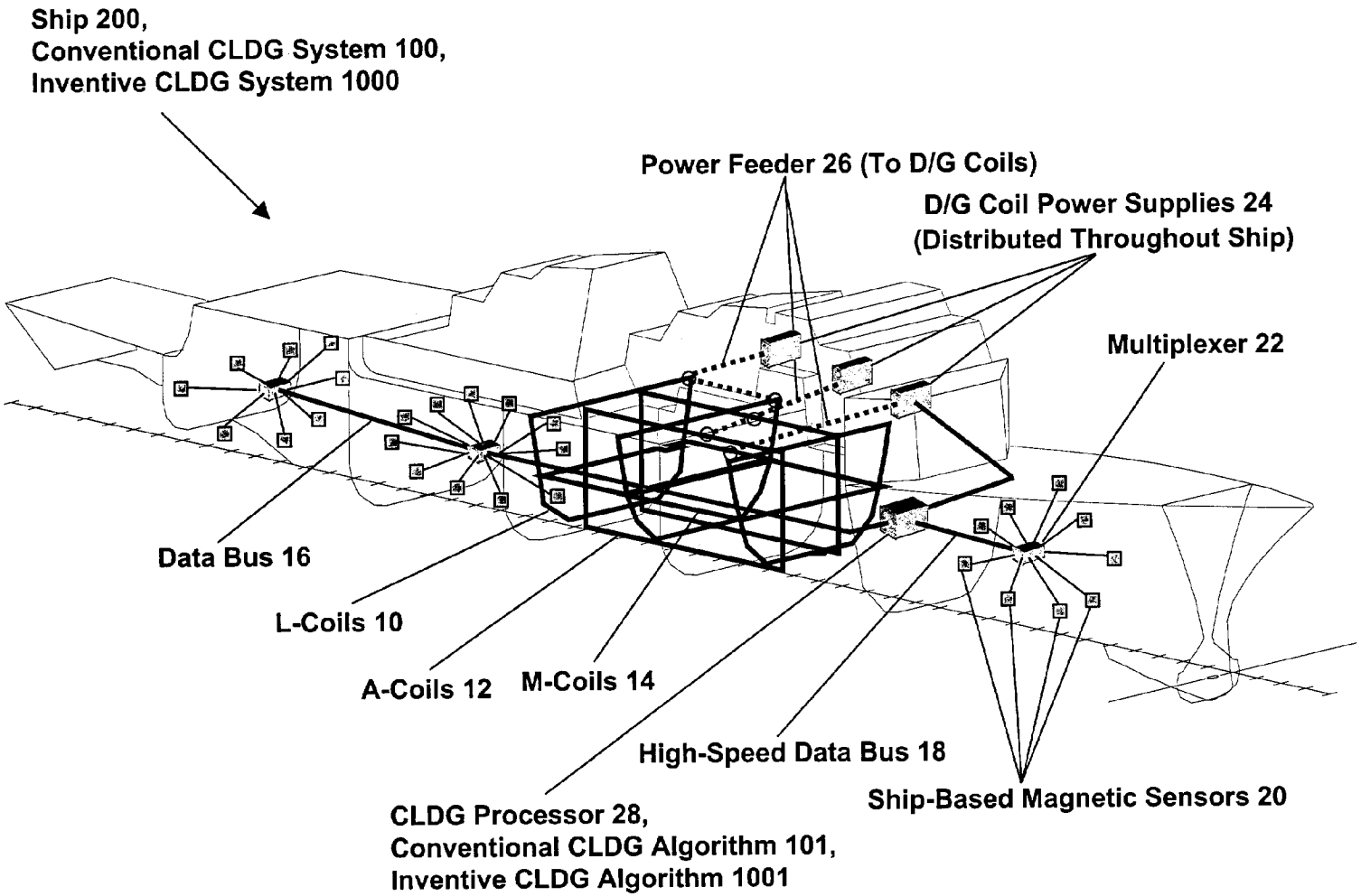
FIG. 2 is another diagrammatic perspective view, similar to the view shown in FIG. 1, of the representative vessel having CLDG shipboard equipment installed therein, particularly illustrating the CLDG shipboard equipment. Such CLDG equipment is suitable for implementation of either the current CLDG system shown in FIG. 3 or the present invention's CLDG system shown in FIG. 4.

With reference to FIG. 2, a typical U.S. Navy ship 200 having the current CLDG system 100 installed thereon is equipped with plural L-coils 10, plural A-coils 12, plural M-coils 14, a first data bus 16, a second (high speed) data bus 18, plural ship-based magnetic sensors 20, multiplexers 22 (each multiplexer 22 associated with a group of magnetic sensors 20), plural degaussing coil power supplies 24 (distributed throughout ship 200), a power feeder 26 (to the degaussing coils 10, 12 and 14), and a CLDG processor 28. The CLDG system, whether the current CLDG system 100 or the inventive CLDG 1000, will automatically monitor and maintain the ferromagnetic signature of ship 200 at a low level for all operational maneuvers and geographic locations. The U.S. Navy's current state of technology is to effect the current CLDG system 100, according to which is used, installed in the memory of CLDG processor 28, the current CLDG control algorithm 101 such as illustrated in FIG. 3.

Figure 4:
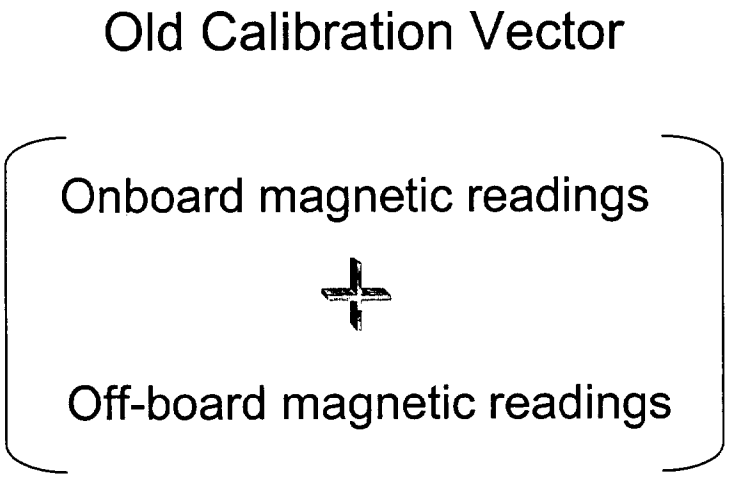
FIG. 4 is a diagrammatic representation of the calibration vector path of the current CLDG system.

Referring to FIG. 3 and FIG. 4, according to the current CLDG system 100 the electromagnetic fields are initially measured ("Step 1"). Coil effects are subtracted therefrom ("Step 2"). A least-squares fit of the "target" vector (thus obtained onboard the ship via steps "1" and "2") is effected onboard the ship with respect to the onboard magnetic measurement components of the calibration vectors (previously obtained at a shore facility 23), thereby obtaining "scale" factors useful for predicting a total off-board signature consisting of three vector states, viz., (i) permanent ("PERM") vectors, (ii) change in permanent ("A PERM") vectors, and (iii) induced ("INDUCED") vectors ("Step 3"). The predicted off-board signature is determined based on multiplication of the off-board section of each calibration vector by its "scale factor" obtained in step "3" ("Step 4"). An off-board least-squares fit is effected to degauss the predicted off-board signature ("Step 5"). Finally, degaussing currents (flowing through the coils onboard the ship) are set in accordance with the predicted off-board signature ("Step 6").

The current CLDG 100 methodology, depicted in FIG. 3, is imperfect. As shown in FIG. 4, the current CLDG algorithm uses calibration measurements of correlated onboard plus off-board magnetic fields. During the execution of the real-time algorithm, this calibration database is used to predict a total off-board magnetic signature. This signature is then fit with a set of degaussing coil signatures using a least squares minimization, followed by the setting of currents ("degaussing") in accordance therewith. Since there is no active verification of the degaussed signature, a single pass at this minimization is all that is available.

The unverified signature fit errors according to the current CLDG algorithm 101 are greater than five percent RMS of the un-degaussed. Among the sources of these errors are the following: (i) change in ship position from coil effects to cal vectors (These items cannot be measured at the same time; they are often measured days apart); (ii) error from sensor drift over time; (iii) gain and linearity error from repeated "permings" during cal vector creation; (iv) frequent necessity, due to tide and wind, of magnetic modeling of the off-board data to a standard grid; (v) inability to attempt any performance "tuning" until all vectors are obtained.

Reference now being made to FIG. 5 through FIG. 8, the CLDG system 1000 in accordance with the present invention will implement essentially the identical CLDG-related apparatus as will the current CLDG system 1000, such as that which is illustrated in FIG. 2. That is, basically the same CLDG equipment is used regardless of whether the current algorithm 101 (shown in FIG. 3) or the inventive algorithm 1001 (shown in FIG. 5) is used. In accordance with the present invention, however, the current CLDG control algorithm 101 will not be installed in the memory of CLDG processor 28 (which has both processing and controlling capabilities). Instead, according to the present invention's CLDG system 1000, the present invention's control algorithm 1001 will be installed in the memory of CLDG processor 28.

Figure 5:
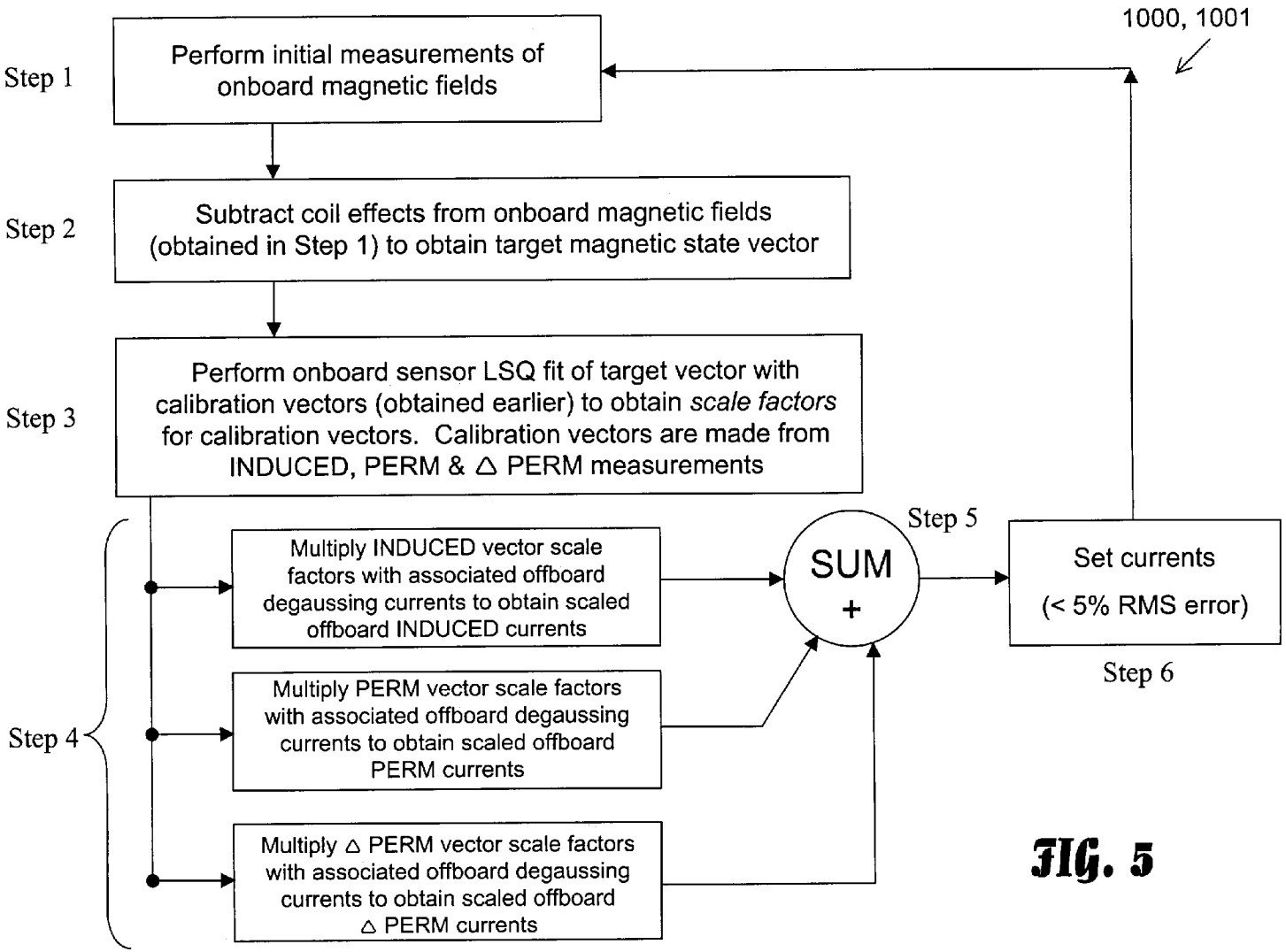
FIG. 5 is a block diagram of an embodiment of the new CLDG system in accordance with the present invention.
Figure 7:
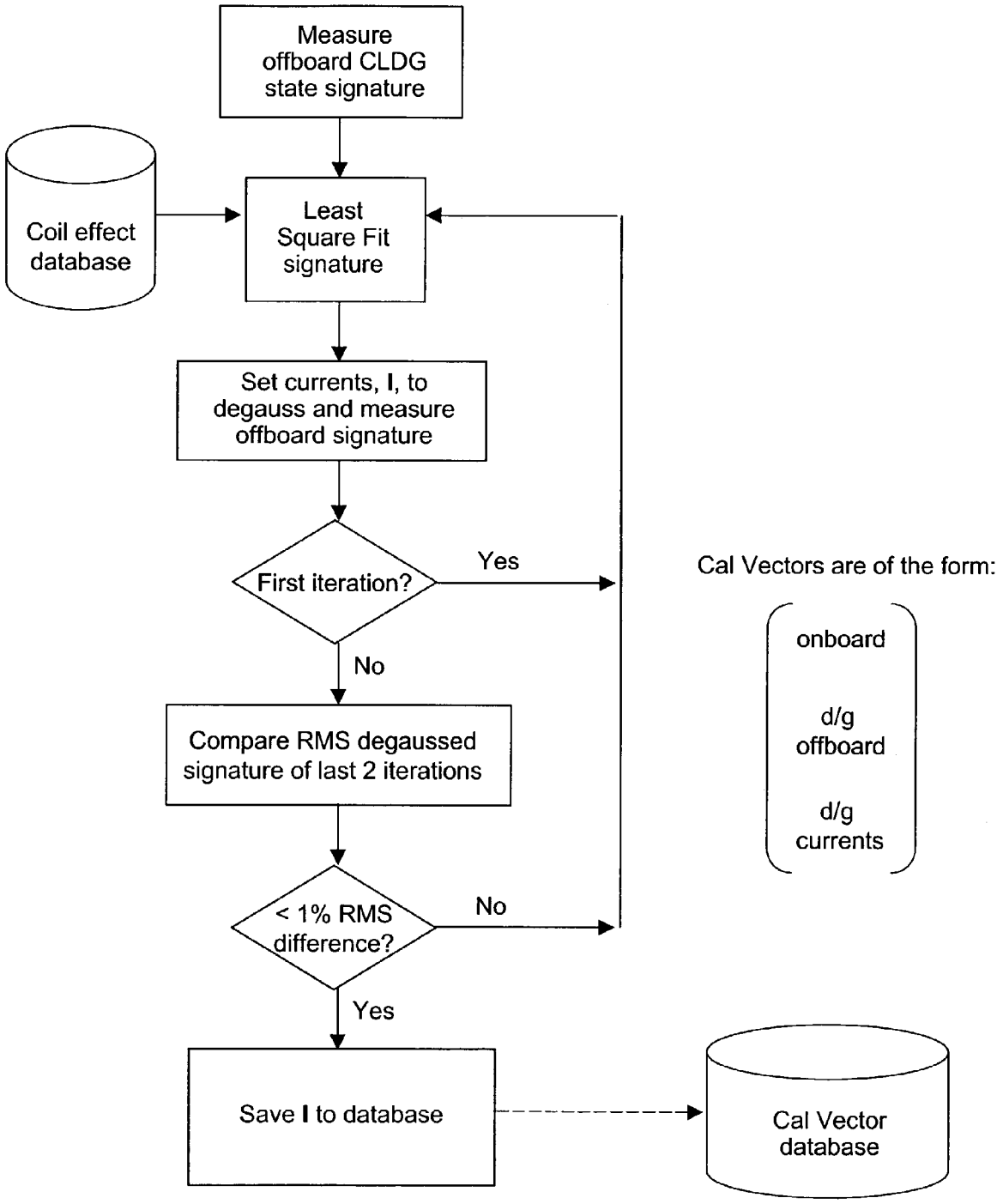
FIG. 7 is a flow diagram illustrating the implementation and general constructs of calibration of an embodiment of a CLDG system in accordance with the present invention.

The basic algorithm 1001 for the present invention is shown in FIG. 5, and bears some similarity to the existing CLDG algorithm 101 shown in FIG. 3. In contrast thereto, the present invention's CLDG algorithm 1001 requires each calibration state to be degaussed beforehand to less than 5% RMS of the calibration state's initial signal. The degaussing currents for each calibration state are then saved and associated directly with the calibration state's vector. These currents are scaled based on an initial onboard Least Square signature fit and then summed to create the final degaussing currents that will be applied to minimize the ship's off-board signature.

"Step 3" according to the current ("old") CLDG algorithm 101 and "Step 3" according to the present invention's ("new") CLDG algorithm 1001 are similar. The onboard magnetic field measurements taken while the ship is navigating ("Step 1"), offset by measured coil effects ("Step 2"), are fit (e.g., via mathematical LSQ calculation) with the onboard magnetic measurement components ("onboard magnetic readings" in FIG. 4 and FIG. 6) of the calibration vector. However, there is a significant difference between the old CLDG algorithm 101 calibration vectors (shown in FIG. 4) and the new CLDG algorithm 1001 calibration vectors (shown in FIG. 6). The old CLDG algorithm 101 calibration vector is of the form [(onboard magnetic readings) plus (off-board magnetic readings)]. The new CLDG algorithm 1001 calibration vector is of the form [(onboard magnetic readings) plus (off-board magnetic readings) plus (degaussing currents I)]. According to the present invention's CLDG algorithm 1001, the off-board measurement components of the degaussing currents I are multiplied by corresponding scale factors ("Step 4"), the resultant products are summed ("Step 5"), and the onboard degaussing coil currents are set accordingly ("Step 6"). Thus, the degaussing currents (flowing through the coils onboard the ship) are set (performed in "Step 6") in accordance with the predicted off-board signature (obtained in "Step 5").

Hence, the new CLDG algorithm 1001 of the present invention avails itself of the same calibration measurements of correlated onboard magnetic fields plus off-board magnetic fields as does the old algorithm 101. However, particularly with reference to FIG. 7, according to the present invention, during the calibration process each measurement is degaussed and a set of coil currents I is obtained. These coil currents I are then set and a "verification" measurement taken. The verification measurement is then degaussed again ("iterated") to verify that it is at a minimum degaussed state. The present invention's algorithm 1001 at this point verifies that the coil currents I that are set will degauss to a minimum the magnetic signature predicted by the old CLDG algorithm 101. The inventive method does not require complex magnetic models and can reduce errors in degaussing.

Figure 6:
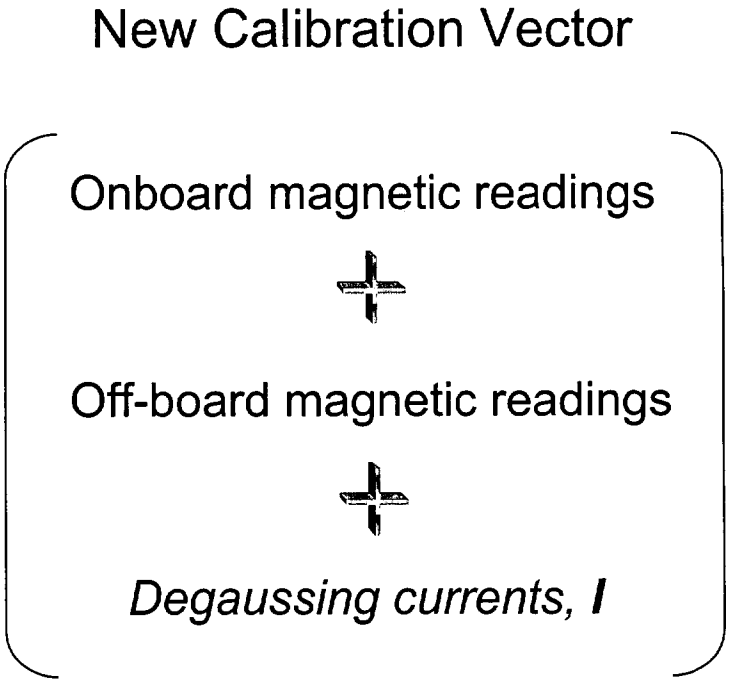
FIG. 6 is a diagrammatic representation of the calibration vector path of an embodiment of a CLDG system in accordance with the present invention.

In terms of advantages, a notable difference between current CLDG system 100 and inventive CLDG system 1000 is that the current CLDG system 100 has a theoretical inaccuracy of about 10% in step "6" of FIG. 3, whereas the present invention's CLDG system 1000 has a theoretical inaccuracy of about 5% or less (and perhaps as low as about 2%) in step "6" of FIG. 4. The verified signature fit errors according to the present invention's CLDG algorithm 1001 are less than 5 percent RMS of the un-degaussed, and are potentially as low as 2 percent RMS or less of the un-degaussed. Among the present invention's features tending to mitigate error are the following: (i) all position and measurement errors are minimized or substantially minimized (to no more that 5% RMS) by iterating the degaussing step for each vector and saving the degaussing currents as part of the new vector; (ii) the degaussing currents are saved in the "I" section, as shown in FIG. 6; (iii) by iterating and degaussing each cal vector the algorithm is "tuned" ahead of time.

Figure 8:
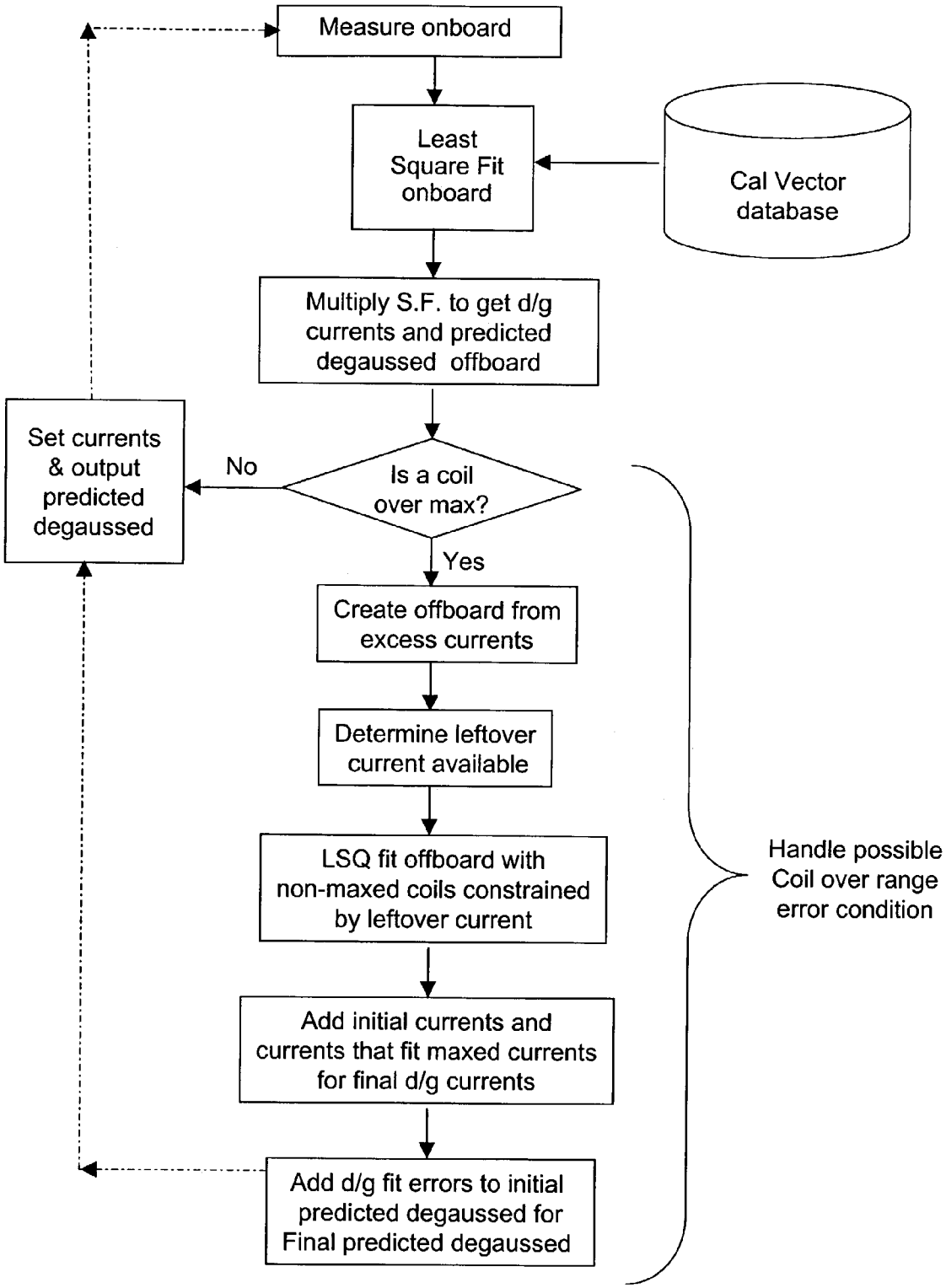
FIG. 8 is a flow diagram illustrating the implementation and general constructs of operation of an embodiment of a CLDG system in accordance with the present invention.

Now referring to FIG. 8, the full mathematical solution for the new algorithm 1001 of the present invention is somewhat similar to, but less complex than, that for the old algorithm 101. The mathematical formulation of the present invention's algorithm 1001 comprises the steps of: (a) finding scale factors; and, (b) multiplying the scale factors with the cal vector currents matrix, to degauss. In order to find the scale factors, the inventive algorithm solves Ax=b, where: b is the onboard measured; Aon is the onboard cal vector matrix; and, x is the cal vector scale factors using the Least Square Method. Thus, $[x]=(At_{on}A_{on})^{-1}At_{on}[b]$, where [x] is the scale factor vector. Then, in order to degauss, the scale factors are multiplied together with the cal vector currents, i.e., [i]=Ai[x].

The present invention's CLDG algorithm 1001 affords two primary advantages, viz., (1) better degaussed signature reduction of Navy ships, and (2) improved prediction of the residual signature. The present invention affords superior degaussed signature reduction because the final CLDG degaussing currents are derived with iteration, and the present invention's algorithm 1001 uses just one Least Square fit; hence, the net degaussed signature is expected to be at least 50% lower with the present invention's methodology. The present invention's prediction of the residual signature is superior because the iterated degaussed off-board states are verified beforehand. Moreover, the present invention's CLDG algorithm provides the secondary advantage of a simplified procedure. Magnetic modeling of the off-board signature is no longer necessary, so this step and the errors inherent therein are eliminated.

Other embodiments of the present invention will be apparent to those skilled in the art from a consideration of this specification or practice of the invention disclosed herein. Various omissions, modifications and changes to the principles described herein may be made by one skilled in the art without departing from the true scope and spirit of the invention which is indicated by the following claims.

What is claimed is:

1. A method for effecting closed loop degaussing of a marine vessel having degaussing coils associated therewith, said method comprising:

during non-navigation of said marine vessel: obtaining calibration onboard magnetic field measurements relating to said marine vessel; iteratively, at least twice, applying degaussing current to said degaussing coils until reaching a selected reduction of the off-board magnetic signature relating to said marine vessel; and obtaining current values of said degaussing current which is applied upon said reaching of said selected reduction of the off-board magnetic signature; and during navigation of said marine vessel: obtaining real time onboard magnetic field measurements relating to said marine vessel; determining scale factors, said determining scale factors including fitting said obtained real time onboard magnetic field measurements with respect to said obtained calibration onboard magnetic field measurements; finding products of said determined scale factors and said obtained current values; and applying degaussing current to said degaussing coils in accordance with the summation of said products.

2. The method according to claim 1, wherein:

the un-degaussed off-board magnetic signature is the off-board magnetic signature existing in the absence of any application of degaussing current;

said application of current during non-navigation of said marine vessel results in a preliminarily degaussed off-board magnetic signature which is smaller than said un-degaussed off-board magnetic signature; and said application of current during navigation of said marine vessel results in a finally degaussed off-board magnetic signature which is no larger than said preliminarily degaussed off-board magnetic signature.

3. The method according to claim 2, wherein said preliminarily degaussed off-board magnetic signature and said finally degaussed off-board magnetic signature are each no more than five percent root mean square of said un-degaussed off-board magnetic signature.

4. The method according to claim 1, wherein said fitting of said obtained real time onboard magnetic field measurements with respect to said obtained onboard magnetic field calibration measurements includes performing a least squares fit approximation.

5. The method according to claim 1, wherein said obtained real time onboard magnetic field measurements, said obtained onboard magnetic field calibration measurements and said obtained current values each correspond to three magnetic vector states, said three magnetic vector states being the induced magnetic vector state, the permanent magnetic vector state and the change-in-permanent magnetic vector state.

6. The method according to claim 5, wherein:

said determined scale factors correspond to said three magnetic vector states; and said finding of said products includes multiplying said determined scale factors and said obtained current values in pairs which correspond to the same said magnetic vector state.

7. The method according to claim 1, wherein said real time onboard magnetic field measurements are obtained so as to account for magnetic influence of said degaussing coils.

8. The method according to claim 1, wherein the steps performed during navigation of said marine vessel are performed in the context of a closed loop system involving said degaussing coils and computer controller means, said computer controller means being utilized onboard said marine vessel for performing said steps on a continuous feedback basis during navigation of said marine vessel.

9. A closed loop degaussing system for a ship, said system comprising plural degaussing coils and a machine having a memory, said degaussing coils being installed onboard said ship, said machine being connected to said degaussing coils, said machine containing a data representation pertaining to an amount of current to be applied to said degaussing coils so as to at least substantially minimize, on a continual basis, the off-board magnetic signature associated with said ship, said data representation being generated, for availability for containment by said machine, by the method comprising relating presently obtained real time data to previously obtained calibration data, said calibration data including plural onboard signature calibration values and plural current calibration values, said current calibration values being indicative of the amount of current used to at least substantially minimize, on a calibration basis, the off-board magnetic signature associated with said ship, said real time data including plural onboard signature real time values and real time scale factors, said relating of said real time data to said calibration data including:

calculating real time scale values, said calculating real time scale values including performing a least squares fit of said onboard signature real time values relative to said onboard signature calibration values;

multiplying said calculated real time scale values by said current calibration values;

summing the products of said multiplying; and causing the application of current to said degaussing coils in an amount indicative of said summed products.

10. The closed loop degaussing system as recited in claim 9, wherein each of said onboard signature real time values, said onboard signature calibration values, said current calibration values and said calculated real time scale values belongs to one of three magnetic field vector categories, said three magnetic field vector categories being induced, permanent and change-in-permanent.

11. The closed loop degaussing system as recited in claim 10, wherein each said product is of a said calculated real time scale value and a said current calibration value which belong to the same said magnetic field vector category.

12. The closed loop degaussing system as recited in claim 9, wherein said onboard signature real time values account for magnetic effects of said degaussing coils.

13. A computer program product comprising a computer useable medium having computer program logic recorded thereon for enabling a computer to control the amount of current conducted by degaussing coils which are installed onboard a ship, said computer program logic comprising:

means for enabling said computer to input onboard signature calibration values and current calibration values which have previously been obtained at a magnetic calibration facility, said current calibration values being representative of a substantially minimized off-board magnetic signature associated with said ship;

means for enabling said computer, in an ongoing manner, to input onboard signature real time values which are presently being obtained onboard said ship;

means for enabling said computer, in an ongoing manner, to compensate said onboard signature real time values for magnetic influence of said degaussing coils, thereby obtaining compensated onboard signature real time values;

means for enabling said computer, in an ongoing manner, to calculate scale factors based on a least squares fit of said compensated onboard signature real time values and said onboard signature calibration values;

means for enabling said computer, in an ongoing manner, to calculate the sum of the products of said calculated scale factors and said current calibration values; and means for enabling said computer, in an ongoing manner, to cause current to be conducted by said degaussing coils in an amount commensurate with said sum of said products.

14. The computer program product as described in claim 13, wherein said onboard signature calibration values, said current calibration values, said onboard signature real time values and said calculated scale factors are each categorized in terms of induced magnetic signature, permanent magnetic signature and change-in-permanent magnetic signature.

15. The computer program product as described in claim 14, wherein each said product is of a said calculated scale factor and a said current calibration value which are identically categorized.

* * * * *